US010837130B2

(12) United States Patent
Di et al.

(10) Patent No.: US 10,837,130 B2
(45) Date of Patent: Nov. 17, 2020

(54) INCANDESCENT TENSION ANNEALING PROCESSES FOR STRONG, TWIST-STABLE CARBON NANOTUBE YARNS AND MUSCLES

(71) Applicant: BOARD OF REGENTS, THE UNIVERSITY OF TEXAS SYSTEM, Austin, TX (US)

(72) Inventors: Jiangtao Di, Dallas, TX (US); Shaoli Fang, Richardson, TX (US); Carter S. Haines, Murphy, TX (US); Na Li, Dallas, TX (US); Ray H. Baughman, Dallas, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 624 days.

(21) Appl. No.: 15/498,882

(22) Filed: Apr. 27, 2017

(65) Prior Publication Data

US 2018/0327937 A1 Nov. 15, 2018

Related U.S. Application Data

(60) Provisional application No. 62/328,242, filed on Apr. 27, 2016.

(51) Int. Cl.

| | |
|---|---|
| ***D02J 1/22*** | (2006.01) |
| ***D02J 11/00*** | (2006.01) |
| ***D02G 3/02*** | (2006.01) |
| ***D02G 3/04*** | (2006.01) |
| ***D02J 13/00*** | (2006.01) |

(Continued)

(52) U.S. Cl.

CPC ..... *D02J 1/224* (2013.01); *D02G 3/02* (2013.01); *D02G 3/04* (2013.01); *D02G 3/26* (2013.01); *D02J 1/22* (2013.01); *D02J 11/00* (2013.01); *D02J 13/00* (2013.01); *D06M 10/00* (2013.01);

(Continued)

(58) Field of Classification Search

CPC ... D02G 3/16; D02G 3/26; D02J 1/224; D02J 13/00; D06M 10/00

See application file for complete search history.

(56) References Cited

U.S. PATENT DOCUMENTS 6,764,628 B2 * 7/2004 Lobovsky ..... B82Y 30/00 264/108
9,771,669 B2 * 9/2017 Kumar ..... D01F 6/54

(Continued)

OTHER PUBLICATIONS

K. Asaka, M. Karita, Y. Saito, Graphitization of amorphous carbon on a multiwall carbon nanotube surface by catalyst-free heating. Appl Phys Leff 99, 091907 (2011) ("Asaka 2011").

(Continued)

*Primary Examiner* — Shaun R Hurley

(74) *Attorney, Agent, or Firm* — Dickinson Wright PLLC; Ross Spencer Garsson

(57) ABSTRACT

The described incandescent tension annealing processes involve thermally annealing twisted or coiled carbon nanotube (CNT) yarns at high-temperatures (1000° C. to 3000° C.) while these yarns are under tensile loads. These processes can be used for increasing yarn modulus and strength and for stabilizing both twisted and coiled CNT yarns with respect to unwanted irreversible untwist, thereby avoiding the need to tether torsional and tensile artificial muscles, and increasing the mechanical loads that can be moved by these muscles.

28 Claims, 14 Drawing Sheets

(51) Int. Cl.
*D02G 3/26* (2006.01)
*D06M 10/00* (2006.01)
*D06M 101/40* (2006.01)

(52) U.S. Cl.
CPC ... *D06M 2101/40* (2013.01); *D10B 2101/122* (2013.01); *D10B 2509/00* (2013.01)

(56) References Cited

U.S. PATENT DOCUMENTS

2002/0085968 A1* 7/2002 Smalley ..... B01J 19/081 428/367
2002/0113335 A1* 8/2002 Lobovsky ..... B82Y 30/00 264/184
2007/0243124 A1* 10/2007 Baughman ..... B82Y 30/00 423/447.1
2008/0095694 A1* 4/2008 Nakayama ..... B82B 1/00 423/445 B
2008/0170982 A1* 7/2008 Zhang ..... B82Y 10/00 423/447.3
2011/0124483 A1* 5/2011 Shah ..... C04B 35/803 501/32
2014/0231118 A1* 8/2014 Koziol ..... H01B 1/04 174/110 R
2015/0219078 A1* 8/2015 Li ..... D01D 5/0007 310/306
2016/0236938 A1* 8/2016 Johnson ..... C01B 32/168

OTHER PUBLICATIONS

N. Behabtu et al., Strong, light, multifunctional fibers of carbon nanotubes with ultrahigh conductivity. Science 339, 182-186 (2013) ("Behabtu 2013").
K. Behler, S. Osswald, H. Ye, S. Dimovski, Y. Gogotsi, Effect of thermal treatment on the structure of multi-walled carbon nanotubes. J Nanopart Res 8, 615-625 (2006) ("Behler 2006").
P. Chen et al., Hierarchically arranged helical fibre actuators driven by solvents and vapours. Nat Nanotechnol 10, 1077-1083 (2015) ("P. Chen 2015").
X. Chen et al., Novel electric double-layer capacitor with a coaxial fiber structure. Adv Mater 25, 6436-6441 (2013) ("X. Chen 2013").
H. H. Cheng et al., Moisture-activated torsional graphene-fiber motor. Adv Mater 26, 2909-2913 (2014) ("Cheng 2014").
F. Colonna, A. Fasolino, E. J. Meijer, Graphitization of single-wall nanotube bundles at extreme conditions: Collapse or coalescence route. Phys Rev B 88, 165416 (2013) ("Colonna 2013").
V. A. Davis et al., True solutions of single-walled carbon nanotubes for assembly into macroscopic materials. Nat Nanotechnol 4, 830-834 (2009) ("Davis 2009").
L. M. Ericson et al., Macroscopic, neat, single-walled carbon nanotube fibers. Science 305, 1447-1450 (2004) ("Ericson 2004").
C. Fang et al., Enhanced carbon nanotube fibers by polyimide. Appl Phys Lett 97, 181906 (2010) ("Fang 2010").
T. Filleter, H. D. Espinosa, Multi-scale mechanical improvement produced in carbon nanotube fibers by irradiation cross-linking. Carbon 56, 1-11 (2013) ("Filleter 2003").
J. Foroughi et al., Torsional carbon nanotube artificial muscles. Science 334, 494-497 (2011) ("Foroughi 2011").
H. R. Gutierrez, U. J. Kim, J. P. Kim, P. C. Eklund, Thermal conversion of bundled carbon nanotubes into graphitic ribbons. Nano Lett 5, 2195-2201 (2005) ("Gutierrez 2005").
S. He et al., A Mechanically Actuating carbon-nanotube fiber in response to water and moisture. Angew Chem Int Ed 127, 15093-15097 (2015) ("He 2015").
J. Y. Huang, S. Chen, Z. F. Ren, G. Chen, M. S. Dresselhaus, Real-time observation of tubule formation from amorphous carbon nanowires under high-bias Joule heating. Nano Lett 6, 1699-1705 (2006) ("J. Huang 2006").
W. Huang, Y. Wang, G. Luo, F. Wei, 99.9% purity multi-walled carbon nanotubes by vacuum high-temperature annealing. Carbon 41, 2585-2590 (2003) ("W. Huang 2003").
C. Jayasinghe, S. Chakrabarti, M. J. Schulz, V. Shanov, Spinning yarn from long carbon nanotube arrays. J Mater Res 26, 645-651 (2011) ("Jayasinghe 2011").
K. L. Jiang, Q. Q. Li, S. S. Fan, Nanotechnology: Spinning continuous carbon nanotube yarns—Carbon nanotubes weave their way into a range of imaginative macroscopic applications. Nature 419, 801 (2002) ("Jiang 2002").
R. K. Josephson, Contraction dynamics and power output of skeletal muscle. Annu Rev Physiol 55, 527-546 (1993) ("Josephson 1993").
A. Kis et al., Reinforcement of single-walled carbon nanotube bundles by intertube bridging. Nat Mater 3, 153-157 (2004) ("Kris 2004").
A. V. Krasheninnikov, F. Banhart, Engineering of nanostructured carbon materials with electron or ion beams. Nat Mater 6, 723-733 (2007) ("Krasheninnikov 2007").
Y. Li et al., Overtwisted, resolvable carbon nanotube yarn entanglement as strain sensors and rotational actuators. ACS Nano 7, 8128-8135 (2013) ("Li 2013").
Y. L. Li, I. A. Kinloch, A. H. Windle, Direct spinning of carbon nanotube fibers from chemical vapor deposition synthesis. Science 304, 276-278 (2004) ("Li 2004").
M. D. Lima et al., Efficient, Absorption-powered artificial muscles based on carbon nanotube hybrid yarns. Small 11, 3113-3118 (2015) ("Lima 2015").
M. D. Lima et al., Electrically, chemically, and photonically powered torsional and tensile actuation of hybrid carbon nanotube yarn muscles. Science 338, 928-932 (2012) ("Lima 2012").
K. Liu et al., Scratch-resistant, highly conductive, and high-strength carbon nanotube-based composite yarns. ACS Nano 4, 5827-5834 (2010) ("Liu 2010").
W. Lu, M. Zu, J. H. Byun, B. S. Kim, T. W. Chou, State of the art of carbon nanotube fibers: opportunities and challenges. Adv Mater 24, 1805-1833 (2012) ("Lu 2012").
M. Miao et al., Effect of gamma-irradiation on the mechanical properties of carbon nanotube yarns. Carbon 49, 4940-4947 (2011) ("Miao 2011").
A. N. Parra-Vasquez et al., Spontaneous dissolution of ultralong single- and multiwalled carbon nanotubes. ACS Nano 4, 3969-3978 (2010) ("Parra-Vasquez 2010").
S. Ryu et al., High-strength carbon nanotube fibers fabricated by infiltration and curing of mussel-inspired catecholamine polymer. Adv Mater 23, 1971-1975 (2011) ("Ryu 2011").
E. Salonen, A. Krasheninnikov, K. Nordlund, Ion-irradiation-induced defects in bundles of carbon nanotubes. Nucl. Instrum. Methods Phys. Res., Sect. B 193, 603-608 (2002) ("Salonen 2002").
M. Terrones, H. Terrones, F. Banhart, J. Charlier, P. M. Ajayan, Coalescence of single-walled carbon nanotubes. Science 288, 1226-1229 (2000) ("Terrones 2000").
B. Vigolo et al., Macroscopic fibers and ribbons of oriented carbon nanotubes. Science 290, 1331-1334 (2000) ("Vigolo 2000").
G. Yamamoto et al., Structure-property relationships in thermally-annealed multiwalled carbon nanotubes. Carbon 66, 219-226 (2014) ("Yamamoto 2014").
W. Weng et al., Winding aligned carbon nanotube composite yarns into coaxial fiber full batteries with high performances. Nano Lett 14, 3432-3438 (2014) ("Weng 2014").
M. Zhang, K. R. Atkinson, R. H. Baughman, Multifunctional carbon nanotube yarns by downsizing an ancient technology. Science 306, 1358-1361 (2004) ("M. Zhang 2004").
X. B. Zhang et al., Spinning and processing continuous yarns from 4-inch wafer scale super-aligned carbon nanotube arrays. Adv Mater 18, 1505-1510 (2006) ("X.B. Zhang 2006").
PCT Patent WO2011005375, Fabrication of biscrolled fiber using carbon nanotube sheet. to S. Fang, filed May 27, 2010 ("S. Fang '375 PCT Application").
X. F. Zhang et al., Ultrastrong, stiff, and lightweight carbon-nanotube fibers. Adv Mater 19, 4198-4201 (2007) ("X.F. Zhang 2007").

(56) References Cited

OTHER PUBLICATIONS

PCT Patent Appl. Publ. No. WO2014/0022667, "Coiled and non-coiled twisted nanofiber yarn and polymer fiber torsional and tensile actuators," to N. Li, filed Aug. 1, 2013 ("Li '667 PCT Application").

* cited by examiner

INCANDESCENT TENSION ANNEALING PROCESSES FOR STRONG, TWIST-STABLE CARBON NANOTUBE YARNS AND MUSCLES

CROSS-REFERENCE TO RELATED PATENT APPLICATIONS

This application claims priority to provisional U.S. Patent Application Ser. No. 62/328,242, filed Apr. 27, 2016, entitled "Incandescent Tension Annealing Processes For Strong, Twist-Stable Carbon Nanotube Yarns And Muscles," which provisional patent application is commonly owned by the Applicant of the present invention and is hereby incorporated herein by reference in its entirety for all purposes.

GOVERNMENT INTEREST

This invention was made with government support under the Air Force Office of Scientific Research grants FA9550-12-1-0035, FA9550-12-1-0211, and FA2386-13-1-4119; Robert A. Welch Foundation grant AT-0029; National Science Foundation grant CMMI1335204; Office of Naval Research MURI grant NOOD14-11-1-0691; and the Army grant W91CBR-13-C-0037. The government has certain rights in the invention.

FIELD OF THE INVENTION

The present invention is directed to incandescent tension annealing processes for strong, twist-stable carbon nanotube yarns and muscles.

BACKGROUND

Twist-spun carbon nanotube (CNT) yarns are of great interest for such diverse applications as artificial muscles [Foroughi 2011; Lima 2012; P. Chen 2015], supercapacitors [X. Chen 2013], batteries [Weng 2014], and intelligent textiles and structural composites [Lu 2012; Liu 2010]. While inserted twist can generate new properties [Foroughi 2011] and improve other properties [M. Zhang 2004], an important problem exists: single-ply twisted or coiled neat CNT yarns will irreversibly untwist unless they are torsionally tethered [Li 2013]. This problem is particularly troublesome for twist-spun CNT yarn artificial muscles, which can be driven either electrochemically [Foroughi 2011], electrothermally [Lima 2012], or chemically [Lima 2015] to provide torsional and tensile actuation. It is also a key problem for twist retention during weaving CNT yarns.

Various important means are now available for continuously making CNT yarns by either liquid-state [Vigolo 2000; Ericson 2004; Behabtu 2013] or dry-state methods [M. Zhang 2014; Jiang 2002; Li 2004; X. F. Zhang 2007; X. B. Zhang 2006; Jayasinghe 2011].

The present invention is directed to yarns made by a twist-based process, wherein CNT aerogel sheets drawn from spinnable nanotube forests are twisted into yarn during the draw process [M. Zhang 2004]. Twist-spun yarns have importance in providing high-performance torsional and tensile artificial muscles [Foroughi 2011; Lima 2012; P. Chen 2015], which are called either twisted yarns or coiled yarns, depending upon whether the inserted twist is below or above the amount required to produce yarn coiling. When infiltrated with electrolyte and electrochemically driven, these two-end tethered yarns can rotate a rotor at speeds exceeding 590 rpm, providing torsional strokes per yarn length of 125° $mm^{-1}$ [Foroughi 2011]. Infiltration with volume-changing guests produced twisted yarns that provided torsional speeds of up to 11,500 rpm [Lima 2012]. The coiled yarns infiltrated with paraffin wax and silicone rubber could be thermally [Lima 2012] or chemically [Lima 2015] actuated to accomplish 0.836 kJ $kg^{-1}$ and 1.2 kJ $kg^{-1}$ of mechanical work during muscle contraction, respectively. These work capacities are greater than 31 times that for natural muscle (0.039 kJ $kg^{-1}$) [Josephson 1993].

Despite the impressive performance, single-ply twisted and single-ply coiled CNT yarn muscles must be torsionally tethered to prevent irreversible untwist during tensile actuation [Lima 2012] and need a non-actuating segment or the infiltration of elastic guest materials as a returning spring for torsional actuation [Foroughi 2011; Lima 2012; Lima 2015], which could cause inconveniences for practical applications. The tensile work capacity of these muscles increases with increasing load until the yarn muscle mechanically fails [Lima 2015]. The present invention provides increased mechanical bonding within the yarn structure that increases both twist retention and mechanical strength.

While infiltration of CNT yarns with polymers provides a well-known means to increase yarn strength, modulus and toughness [Liu 2010; Fang 2010; Ryu 2011], such infiltration cannot be generically applied for CNT yarn muscles, since volume changes of electrolyte or guest within the yarn drive the actuation of the yarn muscle. An alternative approach is to covalently link adjacent nanotubes, such as by using radiation [Kris 2004; Krasheninnikov 2007; Filleter 2003]. Irradiating carbon double-walled nanotube (DWNT) bundles by an electron beam in an electron transmission microscope increased the tensile strength and elastic modulus of the individual nanotube bundle by an order of magnitude, up to maximum values of 1.5-17.1 GPa and 103-693 GPa, respectively [Filleter 2011]. However, application of this approach to micrometers-thick CNT yarns is practically limited by the short penetration length of highly absorbed electron beams. Irradiation of CNT yarns by gamma rays in air increased strength and modulus of CNT yarns possibly due to the formation of carboxyl like groups between adjacent nanotubes, but the final tensile strength of these irradiated yarns was only about 850 MPa [Miao 2011]. Fan's team has importantly shown that thermally annealing twisted CNT yarns in vacuum for several hours at 2000 K, without significant applied tensile stress, increased Young's modulus from 37 to 74 GPa, but slightly decreased yarn strength (from 600 to 564 MPa) [X. B. Zhang 2006].

SUMMARY OF INVENTION

Embodiments of the present invention provide a process for stabilizing both twisted and coiled CNT yarns with respect to unwanted irreversible untwist, thereby avoiding the need to tether torsional and tensile artificial muscles, and increasing the mechanical loads that can be moved by these muscles. This process is called ITAP, which is an abbreviation for "Incandescent Tension Anneal Process", since this process involves thermally annealing a carbon nanotube yarn at incandescent temperatures while the yarn is subjected to tensile stress.

In general, the invention features applying an incandescent tension annealing process to a CNT yarn. In one aspect, the process includes:

a. Wrapping a CNT yarn around two molybdenum hook electrodes.
b. Applying an electrical current through the electrodes to heat the yarn (or an assembly of parallel yarns) to 1000 C-3000 C in a vacuum.
c. Before incandescently heating the yarns, applying a small current to remove the oxygen adsorbed on the CNTs.
d. Applying tensile stress by hanging various size weights on the CNT yarns through the bottom molybdenum hook electrode during high-temperature annealing, while the yarn is torsionally tethered to largely prohibit yarn untwist. The maximum applied stress being about 45% of the fracture strength of the twisted pristine CNT yarns.
e. After interruption of the current at the end of annealing, cooling the yarns to room temperature in the vacuum.

The presently described incandescent tension annealing process could be applied to CNT yarns spun from CNT forests, CNT solution, and CNTs grown by floating catalytic chemical vapor deposition.

The presently described incandescent tension annealing process could be applied to CNT composite yarns comprising guest material, such as graphene oxide, graphene, or ceramics. Such composite yarns can be optionally made by a biscrolling process, wherein the guest material is deposited on a carbon nanotube sheet before or during twist insertion to make a twisted yarn or a coiled yarn [S. Fang '375 PCT Application].

The presently described incandescent tension annealing process can be conducted in a vacuum or in inert gases such as nitrogen, helium, and argon.

The presently described incandescent tension annealing process includes applying tension on the CNT yarns during high-temperature annealing process. The tension can be applied, for instance, by hanging weights on CNT yarns or using tension rods during the continuous processing of CNT yarns.

The presently described incandescent tension annealing process includes applying tension on the CNT yarns at high temperatures of 1000-3000 C, while the yarn is torsionally tethered to largely prohibit yarn untwist. The high annealing temperatures can be achieved by applying current through a CNT yarns, placing the yarn in a high temperature environment, heating the yarn by the absorption of electromagnetic radiation, inductively heating of the yarn, or by a combination of these heating methods.

The presently described incandescent tension annealing process can be conducted continuously or batch by batch.

In general, in another aspect, the invention features a process that includes the step of applying a tensile stress to a CNT yarn. The process further includes the step of high-temperature annealing the CNT yarn while the tensile stress is applied to the CNT yarn to form an ITAP yarn. The high-temperature annealing is performed in the temperature range between 1000 C and 3000 C. The ITAP yarn has a characteristic selected from the group consisting of (i) the tensile strength of the ITAP yarn is greater than the pristine CNT yarn, (ii) the tensile modulus of the ITAP yarn is greater than the pristine CNT yarn, (iii) the pristine CNT yarn was a twisted or coiled CNT yarn, and the twisted or coiled ITAP yarn is stabilized with respect to irreversible untwist or snarling, thereby avoiding the need to tether the twisted or coiled ITAP yarn, (iv) the ITAP yarn is stabilized with respect to chemically-induced yarn degradation, and (v) combinations thereof.

Implementations of the inventions can include one or more of the following features:

The step of high-temperature annealing can include heating the yarn by a method selected from the group consisting of: (a) applying an electrical current through the CNT yarn, (b) placing the yarn in a high-temperature environment, (c) absorption of electromagnetic radiation, (d) inductive heating, and (e) combinations thereof.

The CNT yarn can be not coiled.

The CNT yarn can be twisted. The tensile stress applied to the CNT yarn during the step of high-temperature annealing can be at least 5% of fracture strength of the CNT yarn at room temperature before the step of high-temperature annealing.

The tensile stress applied to the CNT yarn during the step of high-temperature annealing can be at least 20% of the fracture strength of the CNT yarn at room temperature before the step of high-temperature annealing.

The tensile stress applied to the CNT yarn during the step of high-temperature annealing can increase with increasing time over a first time period occurring during the step of high-temperature annealing, while maintaining the tensile stress at below an applied stress level that would cause damage to the CNT yarn at the high-temperature annealing temperature.

The CNT yarn can be coiled and mandrel-free. The tensile stress applied to the CNT yarn can be in an amount that avoids yarn snarling of the CNT yarn.

The tensile stress applied to the coiled CNT yarn can be at least 1% of fracture strength of the coiled CNT yarn at room temperature before the step of high-temperature annealing.

An inert environment can be employed during the step of high-temperature annealing.

The process can further include removing oxygen adsorbed from the CNT yarn before the CNT yarn reaches incandescent temperatures during annealing.

The step of removing oxygen can include a method selected from the group consisting of: (a) applying an electrical current through the CNT yarn, (b) placing the yarn in a high-temperature environment, (c) absorption of electromagnetic radiation, (d) inductive heating, and (e) combinations thereof.

The time of the step of high-temperature annealing can range from 0.1 milliseconds to 2 hours.

The ITAP treatment time can be shortened by increasing the temperature at which the ITAP treatment is accomplished.

The process can further include the method of forming the CNT yarn. The step of forming the CNT yarn can be selected from the group consisting of spinning from CNT forests, CNT solutions, and CNT aerogel sheets grown by floating catalytic chemical vapor deposition.

The process can be a continuous process or a batch by batch process.

The CNT yarn can be part of an assembly of CNT yarns.

The CNT yarns in the assembly can be held under different levels of tensile stresses and temperatures.

Not all of the CNT yarns in the assembly can be subjected to the process described above.

All of the CNT yarns in the assembly can be substantially subjected to the same stress and temperature.

The CNT yarns can be woven into a textile.

At least some portion of the CNT yarns can be plied.

Segments of the CNT yarn can be subjected to the process described above and other segments of the CNT yarn cannot be subjected to the process described above.

The CNT yarn can further include at least one additional material other than CNTs.

The CNT yarn can include a ceramic material.

The CNT yarn can include a second carbon material. The second carbon material is not CNTs.

The second carbon material can include graphene or a graphene derivative.

The CNT yarn can substantially include only CNTs.

In general, in another aspect, the invention features a coiled or highly twisted CNT yarn that substantially contains twist in only one direction and comprises substantially only CNTs. The CNT yarn has a characteristic selected from the group consisting of (i) the CNT yarn does not undergo snarling when untethered, (ii) the CNT yarn substantially retains twist during the release of tethering even when snarling is prohibited, (iii) the CNT yarn substantially retains mechanical strength when exposed to chlorosulfonic acid for 5 minutes at ambient temperature, and (iv) combinations thereof.

Implementations of the inventions can include one or more of the following features: The CNT yarn can include each of the following characteristics (i) the CNT yarn does not undergo snarling when untethered, (ii) the CNT yarn substantially retains twist during the release of tethering even when snarling is prohibited, and (iii) the CNT yarn substantially retains mechanical strength when exposed to chlorosulfonic acid for 5 minutes at ambient temperature.

In general, in another aspect, the invention features an artificial muscle, composite structure, or textile including one or more coiled or highly twisted CNT yarns made by a process that includes applying a tensile stress to a CNT yarn that substantially includes only CNTs. The process to make the one or more coiled or highly twisted CNT yarns further includes high-temperature annealing the CNT yarn while a tensile stress is applied to the CNT yarn to form an ITAP yarn. The high-temperature annealing is performed in the range between 1000 C and 3000 C.

Implementations of the inventions can include one or more of the following features:

The artificial muscle, composite structure, or textile can include one or more twisted CNT yarns. The tensile stress applied to the CNT yarns during the step of high-temperature annealing can be at least 10% of fracture strength of the CNT yarn at room temperature before the step of high-temperature annealing.

The artificial muscle, composite structure, or textile can include one or more twisted CNT yarns. The tensile stress applied to the CNT yarns during the step of high-temperature annealing can be at least 1% of the fracture strength of the coiled CNT yarn at room temperature before the step of high-temperature annealing.

DESCRIPTION OF THE INVENTION

The present disclosure will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems.

As embodied and broadly described, this invention is directed to the method of incandescent tension anneal process for strong, twist-stable carbon nanotube yarns and muscles.

Figure 1:
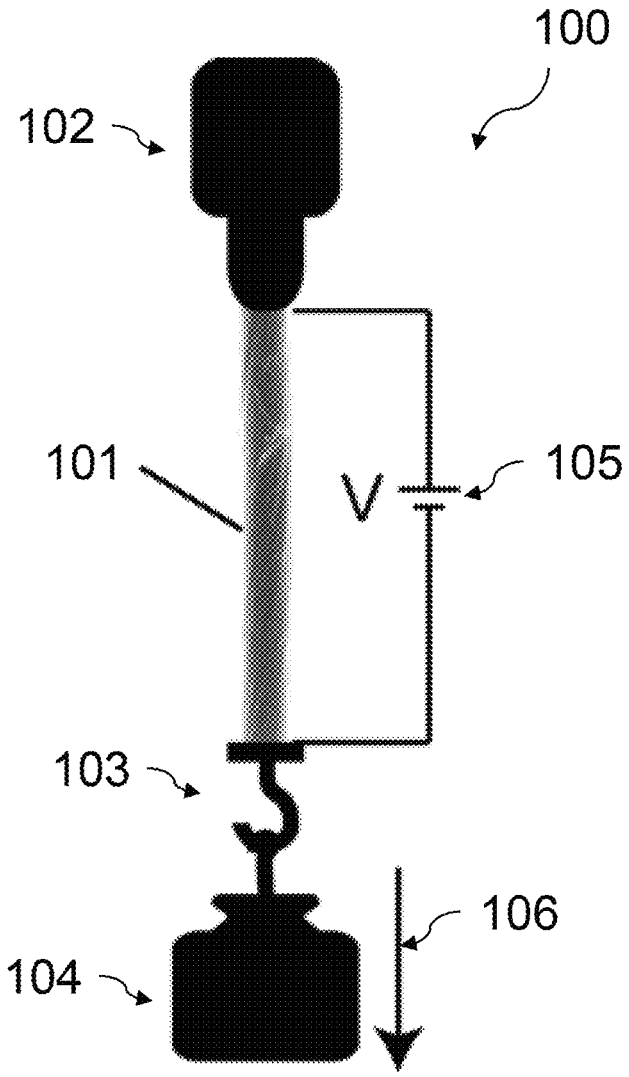
FIG. 1 shows a setup used for an incandescent tension anneal process of the present invention.

In the present invention, a unique method of incandescent tension anneal process, described above, is used for preparing strong, twist-stable carbon nanotube yarns and muscles. FIG. 1 shows the setup 100 used for the incandescent tension anneal process that includes a carbon nanotube yarn 101 wrapped around (or otherwise connected) to electrodes 102 and 103, a weight 104 (attached to electrode 103, which is shown in the shape of a hook, such as a molybdenum hook electrode), and a voltage 105 applied between electrodes 102 and 103. The direction of gravity is shown by arrow 106. For instance, the carbon nanotube yarn 101 that can be used are described in the co-owned Li '667 PCT Application.

The applied stress is normalized as a percent F of the room-temperature tensile strength of precursor yarns, $\sigma_{max}$, and is designated by ITAP-F. Before the ITAP, the highly twisted and the coiled pristine nanotube yarns untwisted and snarled to provide a torque balanced structure when the yarn ends were not tethered. In contrast, the ITAP coiled yarns remained straight and negligibly untwisted upon release of tethering. This indicates that the ITAP enhanced inter-nanotube interactions, which acted as internal springs to hinder yarn untwist.

Figure 2A:
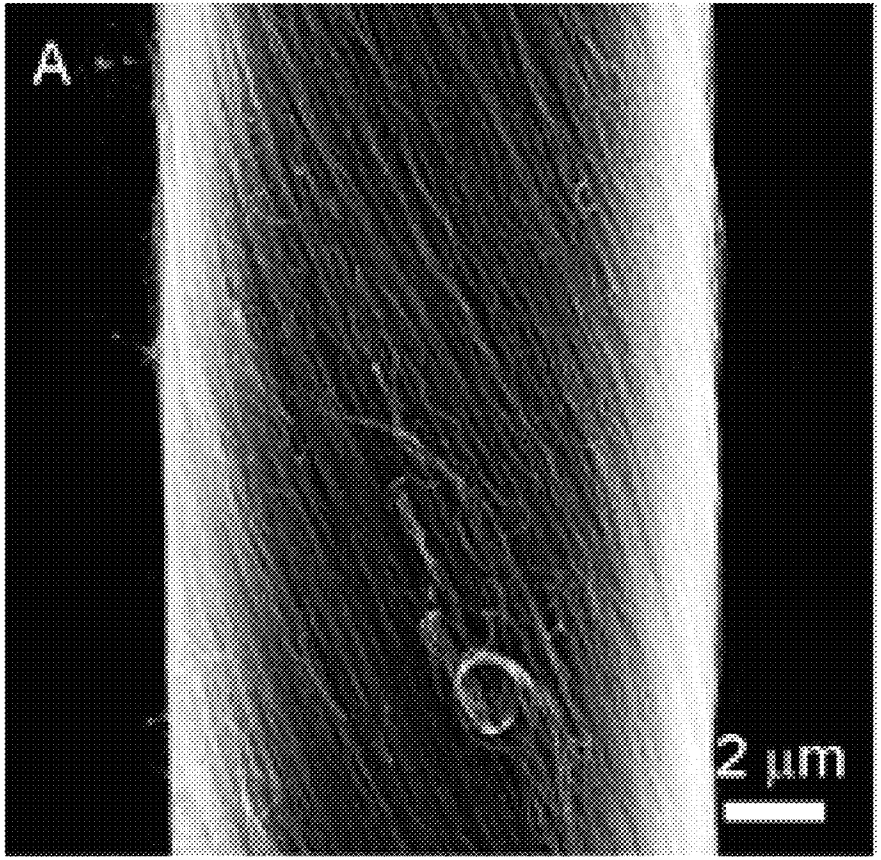
FIG. 2A is a top-view SEM image of a pristine yarn.
Figure 2B:
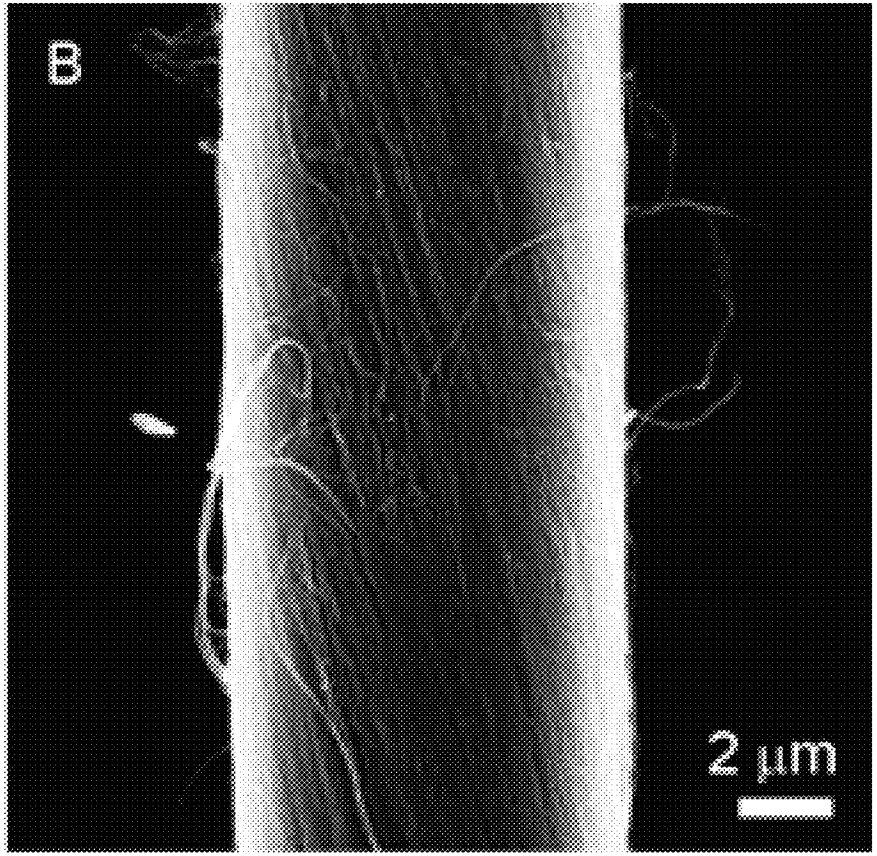
FIG. 2B is a top-view SEM image of an ITAP-40 yarn.

FIG. 2A is a top-view scanning electron microscope (SEM) image of a pristine twisted yarn. FIG. 2B is a top-view SEM image of an ITAP-40 yarn obtained by applying ITAP-40 to the pristine twisted yarn of FIG. 2A. A comparison of FIG. 2A and FIG. 2B show that the ITAP-40 yarn decreased both yarn bias angle (a) and diameter (d). The bias angles for the ITAP yarns were accurately predicted from the bias angles for the pristine yarns and the relative diameters of pristine and ITAP yarns by using the equation:

$$\alpha=\tan^{-1}(\pi dT)$$

where T is the inserted twist per yarn length.

Figure 2C:
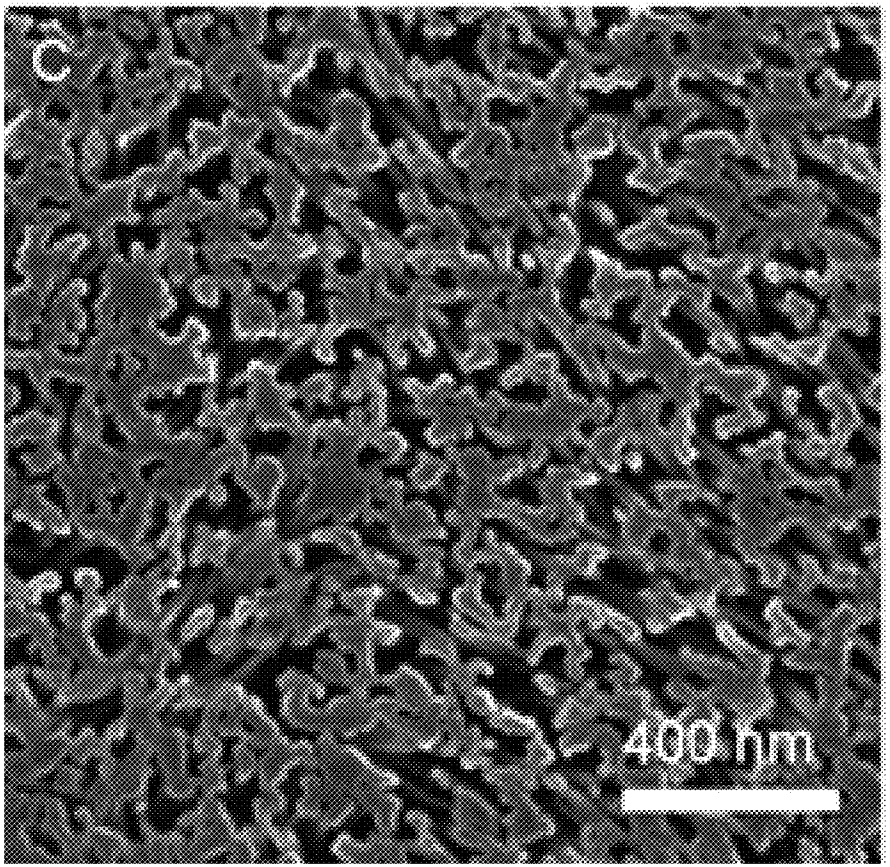
FIG. 2C is a cross-sectional SEM image of the pristine yarn of FIG. 2A.
Figure 2D:
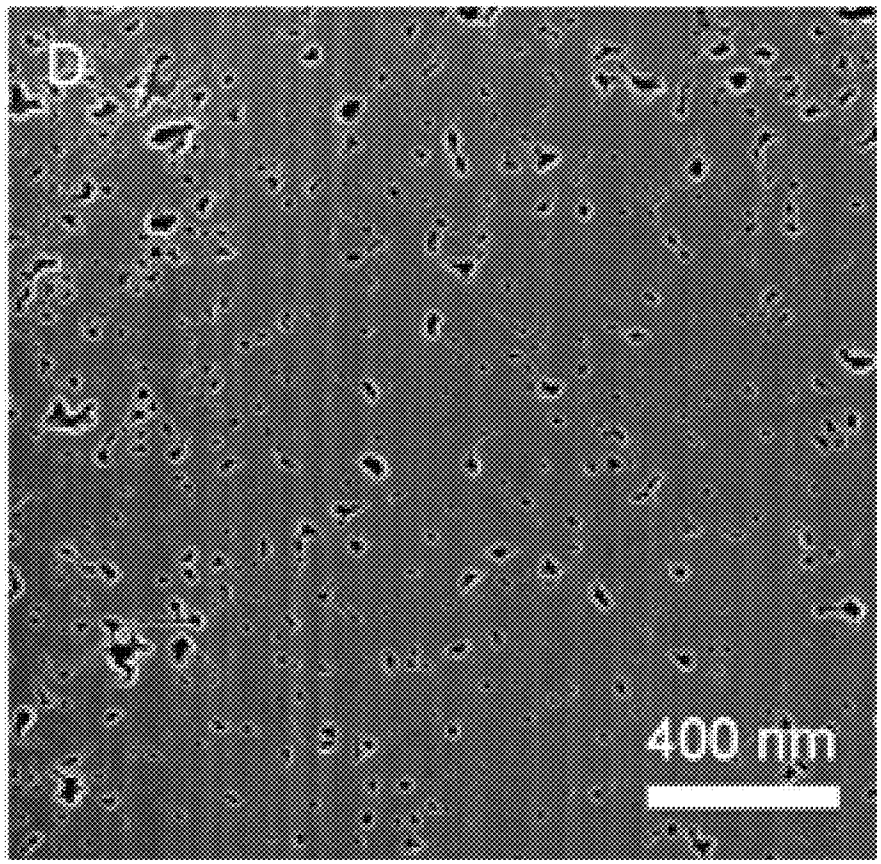
FIG. 2D is a cross-sectional SEM image of the ITAP-40 yarn of FIG. 2B.

FIGS. 2C-2D are the cross-sectional SEM images of the pristine yarn and the ITAP-40 yarn of FIGS. 2A-2B, respectively. A comparison of FIG. 2C and FIG. 2D show the effect of the ITAP-40 on decreasing yarn porosity, which increases from yarn center to yarn surface. Corresponding to the increase in average yarn density from 0.5 to 0.93 g $cm^{-3}$ as a result of ITAP-40, the percentage of cross-sectional area in the images from voids decreased from about 30% to about 15%.

Mechanical test results showed that both the strength and modulus increased with increasing applied tensile stress during the ITAP and tensile strength and modulus (and specific strength and specific modulus) substantially increased during ITAP-40 for all investigated precursor yarn densities.

The achievable strength and modulus enhancements increased with increasing mechanical load applied during the ITAP process until a mechanical load was applied that resulted in yarn fracture during mechanical anneal. Since yarn strength increases during thermal anneal, the maximum mechanical load that can be applied during ITAP can be usefully increased by increasing the mechanical load during the ITAP process, so that at each moment during this process the applied load is below that needed to provide yarn fracture or damage. Hence, a process embodiment is useful wherein the tensile stress applied to the CNT yarn during thermal anneal increases with increasing time in some time periods during the step of high-temperature annealing, while maintaining this stress at below the applied stress that would cause yarn damage at the anneal temperature.

The ITAP treatment time can be shortened by increasing the temperature at which the ITAP treatment is accomplished.

Long-term, high-temperature thermal annealing is known to increase the graphitization of individual CNTs and improve their mechanical properties [Yamamoto 2014]. In contrast, the inventors have found that application of ITAP-30 at ~2000 C for 10 seconds dramatically improved the strengths and moduli of CNT yarns, but did not importantly improve their graphitization, as measured by the intensity ratios of the graphite structure-derived G-band and defect-derived D-band for the twisted ITAP-30 yarns. Thus, the mechanical property enhancements were mainly attributed to enhanced inter-nanotube connections rather than individual nanotube graphitization. Furthermore, the Raman spectra of the ITAP-30 yarns annealed for 2 hours did not show the high G/D intensity ratio of the yarn annealed for the same time but without applying load. These Raman spectroscopy observations suggest that these enhanced inter-nanotube connections are, at least in part, due to inter-nanotube cross-links, and that these cross-links could contribute to the mechanical property improvement and retention of low G/D ratios for the ITAP yarns.

The torque needed to prevent untwist is near zero for the ITAP-40 yarn, since the torque generated by yarn twist is balanced by forces due to ITAP-generated inter-nanotube connections. This explains the stability of ITAP yarns with respect to untwist.

Chlorosulfonic acid can debundle carbon single wall nanotubes and MWNTs and causes CNT structures to swell and then disintegrate due to its strong protonation [Davis 2009; Parra-Vasquez 2010]. The ITAP yarns have long-term structural and mechanical stability in chlorosulfonic acid, with the nanotubes remaining aligned and densely packed and the yarns retaining 82% of its modulus and 90% of its strength after immersion in this acid for 5 minutes. However, the pristine twisted yarn swelled, untwisted, and became disordered after immersion in chlorosulfonic acid for 4 minutes, which led to a 10-fold decrease in yarn strength and a 5.8-fold decrease in modulus. These results suggest that ITAP-induced crosslinking prohibited the chlorosulfonic acid from substantially penetrating and expanding the ITAP yarns. The ITAP yarns also showed increased resistance to oxidation in air compared to pristine yarns.

Unless a torsional return spring is provided, previously described single-ply, twist-spun or coiled CNT yarns cannot be used as a reversible torsional artificial muscle [Foroughi 2011; Lima 2012; P. Chen 2015]. This problem was first characterized for electrochemically-driven single-ply, twist-spun muscles [Foroughi 2011]. The solution used was to two-end torsionally tether the yarn and to actuate only half of its length, so that the non-actuated length functioned as a torsional return spring [Foroughi 2011].

However, the liability of this approach is that it decreases the yarn length that contributes to actuation, and thereby makes the resulting torsional motors unnecessarily long. Instead of using single-ply coiled yarn, Peng's group utilized a helical thread prepared by coiling multi-plied straight CNT yarns, which were relatively stable and showed reversible actuation of rotating a lightweight rotor attached at the thread end when driven by solvent infiltration [P. Chen 2015]. While solid guests in previous described hybrid muscles could act as internal torsional return springs to enable reversible actuation, this restricts the type of yarn guest that can be used, thereby eliminating the possibility of using fully-actuated, non-tethered, single-ply yarns as intelligent actuating sensors that can open and close valves in response to vapors, liquids, and liquid-delivered important biological materials. For these reasons, previously described tensile muscles for controlling valves in response to liquid composition or harvesting electrical energy by using liquid waste streams having different compositions were two-end tethered to prevent torsional rotation [Lima 2015].

Fast, reversible torsional and tensile actuation of guest-free ITAP yarns can be simultaneously realized in response to the absorption and desorption of organic vapors, such as acetone and ethanol. No external torsional tethering or external return spring was needed, since ITAP-produced inter-nanotube connections acted as internal springs within the ITAP yarn. The actuator simply comprises a one-end-supported, coiled, single-ply ITAP muscle that has attached on its opposite end a heavy rotor. Vapor absorption caused the coiled ITAP yarn to untwist and contract in length, while vapor desorption made the yarn retwist and increase in length.

The above major properties changes suggest that the ITAP facilitates crosslinking of the twisted and the coiled structures by providing lateral stresses that draw nanotubes into close proximity and reduce the energy barrier for cross-linking. Additionally, ITAP-enhanced nanotube bundling over substantial fractions of the about 200 mm nanotube length (same as the nanotube forest height) can act similarly to cross-links. Previous experimental and simulation results have demonstrated that nanocarbons such as CNTs, amorphous carbon, and graphene can undergo covalent bond reconfiguration at high temperatures [Terrones 2000; Asaka 2011; Colonna 2013; J Huang 2006]. These covalent structure changes, such as inter-nanotube covalent bonding, nanotube coalescence, and formation of graphitic nanoribbons, can be facilitated by the presence of amorphous carbon and defects in the carbon sidewalls [Gutierrez 2005; Salonen 2002].

In summary, fast, commercially applicable ITAP provides remarkable improvements in the properties of twist-spun and coiled CNT yarns. These improvements include major increases in yarn strength and modulus, increases in oxidative stability and stability to an acid that powerfully protonates yarns and makes them unusable, and the setting of inserted twist for various applications. Since twist retention during nanotube weaving is extremely important, especially for the warp yarns that are highly strained during weaving, this twist setting can be important for commercial production of nanotube textiles for energy storage, harvesting and conversion, sensing, and actuation. This twist retention enables the first single-ply, guest-free, CNT yarns that can serve as reversible tensile and torsional muscles without the need for external return springs that degrade performance metrics. The high speed of the ITAP process at high temperatures facilitates the application of this process during the continuous fabrication and processing of carbon nanotube yarns, including this that are biscrolled to contain solid guest.

The examples provided herein are to more fully illustrate some of the embodiments of the present invention. It should be appreciated by those of skill in the art that the techniques disclosed in the examples which follow represent techniques discovered by the Applicant to function well in the practice of the invention, and thus can be considered to constitute exemplary modes for its practice. However, those of skill in the art should, in light of the present disclosure, appreciate that many changes can be made in the specific embodiments that are disclosed and still obtain a like or similar result without departing from the spirit and scope of the invention.

Examples

In the following examples of the application of invention embodiments, spinnable carbon multi-walled nanotube (MWNT) forests were used for preparing the carbon nanotube yarns. These forests were grown by chemical vapor deposition at about 690 C using iron as catalyst and acetylene gas diluted in argon as the carbon source. A 2-nm-thick iron deposited by electron beam physical vapor deposition was used as catalyst [M. Zhang 2004].

For the yarns used for mechanical property measurements (before and after the ITAP), a twist density of 6000 turns $m^{-1}$ was inserted into a 6 to 10 mm wide carbon nanotube aerogel sheet as it was drawn from a MWNT forest. Yarns having a density of about 0.5 g $cm^{-3}$ were spun by inserting twist in a freestanding MWNT sheet that was under nearly zero applied tensile stress. A 0.4-mm-diameter stainless steel wire was placed at the yarn formation point to apply tensile stress on the yarn during spinning, which increased yarn density up to 0.8 g $cm^{-3}$. To further increase density, up to ~1.25 g $cm^{-3}$, increased tension was applied to the MWNT sheet as it was spun into yarn by passing the sheet through two 0.4-mm-diameter stainless steel wires, and controlling tension by varying the position of these parallel wires. The large diameter yarns that were used to make coiled muscles were prepared by inserting twist into a two-end-tethered, 1.3-cm-wide ribbon comprising a 20-layers stack of parallel, forest-drawn MWNT sheets. During ITAP, the stress applied during thermal annealing of the coiled yarn at 2000 C, was just sufficient to avoid yarn snarling at the beginning of thermal anneal. The stress applied during the ITAP process for the twisted yarns (as a percent F of the precursor yarns strength at room temperature, $\sigma_{max}$) is designated by ITAP-F.

Example 1: Mechanical Property Enhancement by ITAP

Figure 3:
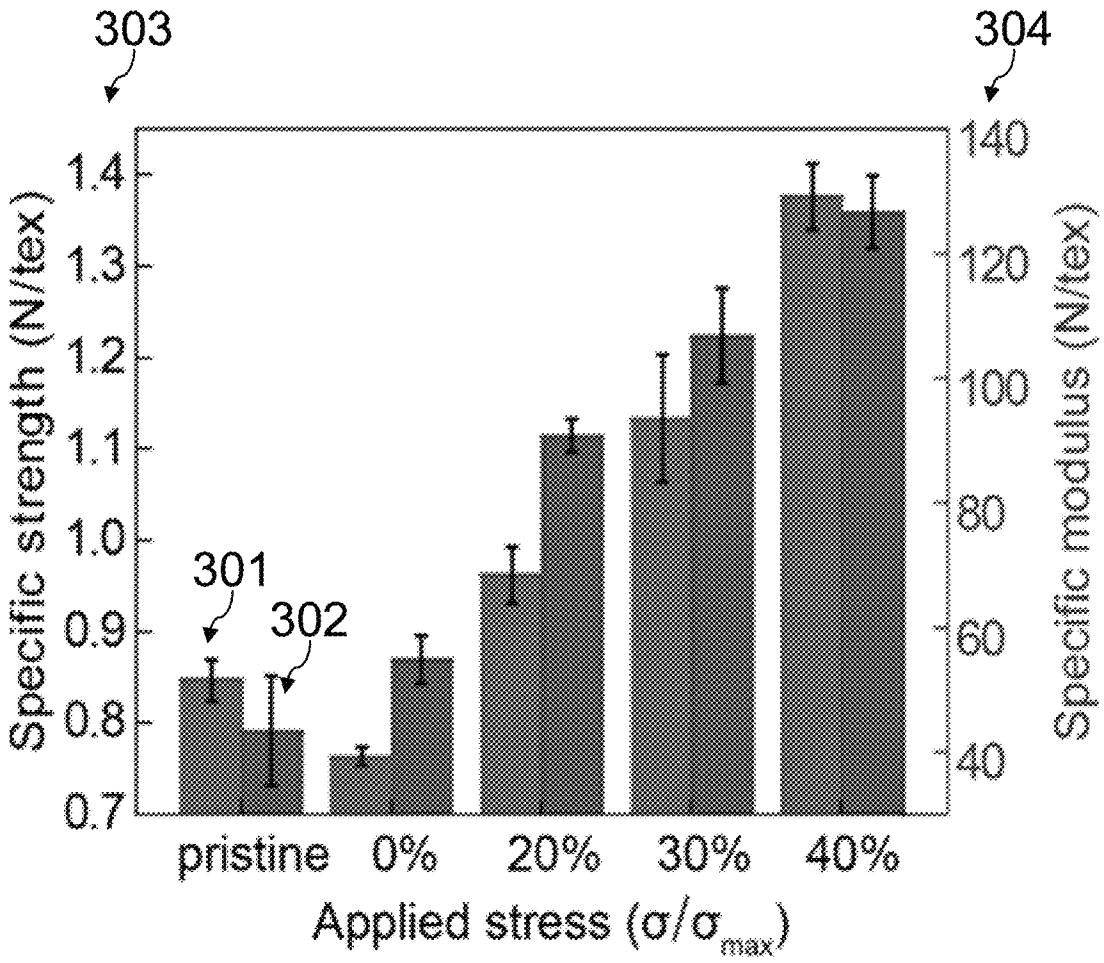
FIG. 3 is a graph showing comparisons of the specific strength and specific modulus of a pristine yarn (1.08 g $cm^{-3}$ in density) and of corresponding ITAP yarns annealed under different applied stresses, where the applied stress during ITAP ($\sigma$), is normalized to the room-temperature fracture strength of the pristine yarn ($\sigma_{max}$).

FIG. 3 is a graph showing comparisons of the specific strength 301 and specific modulus 302 of a pristine yarn (1.08 g $cm^{-3}$ in density) and of corresponding ITAP yarns annealed under different applied stresses, where the applied stress during ITAP (G), is normalized to the fracture strength of the pristine yarn ($\sigma_{max}$). The specific strength 301 is measured in N $tex^{-1}$ as shown by the vertical axis 303. The specific modulus 302 is measured in N $tex^{-1}$ as shown by the vertical axis 304.

A carbon multi-walled nanotube (MWNT) yarn having a density of 1.08 g $cm^{-3}$ was twist-spun from an about 250-mm-high drawable nanotube forest that was synthesized by chemical vapor deposition. Transmission electron microscopy indicates that these MWNTs contain about 9 graphitic walls and have a diameter of ~13 nm. Except as otherwise described, the ITAP involved electrically heating in vacuum the yarns that were under various applied stresses up to about 2000 C. The pristine MWNT yarn had a specific strength (gravimetric strength) of 0.85 N $tex^{-1}$ and a specific modulus (gravimetric Young's modulus) of 43.2 N $tex^{-1}$.

Annealing this twisted yarn at 2000° C. for 2 minutes without applying stress (0% applied stress) caused a 10% decrease in strength and a 27% increase in modulus. Both the strength and modulus increased with increasing applied tensile stress during the ITAP for 2 minutes at 2000° C. At the highest applied stress during ITAP (40% of $\sigma_{max}$), the ITAP-40 process increased specific strength, specific modulus, and density by factors of 1.65, 3, and 1.88, respectively.

Figure 4A:
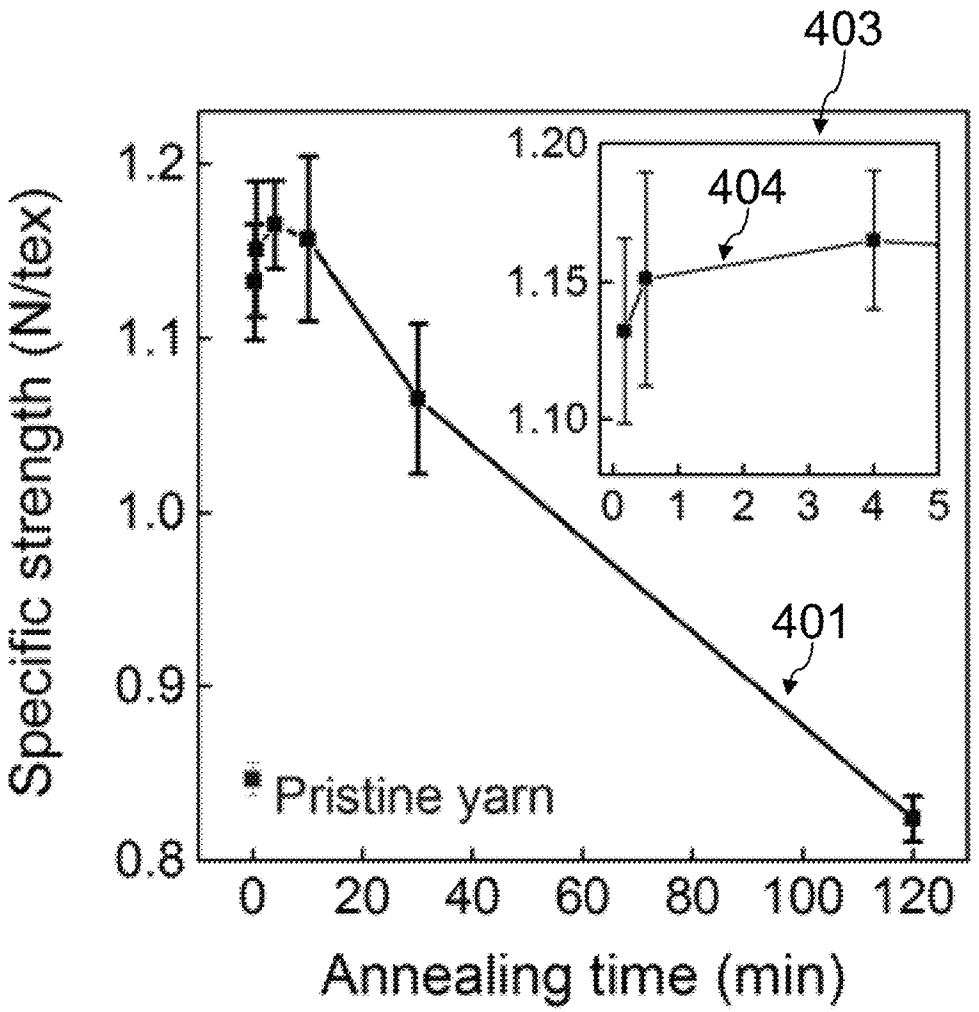
FIG. 4A is a graph showing specific strength as a function of annealing time (at 2000° C. under 30% $\sigma_{max}$) during the ITAP.
Figure 4B:
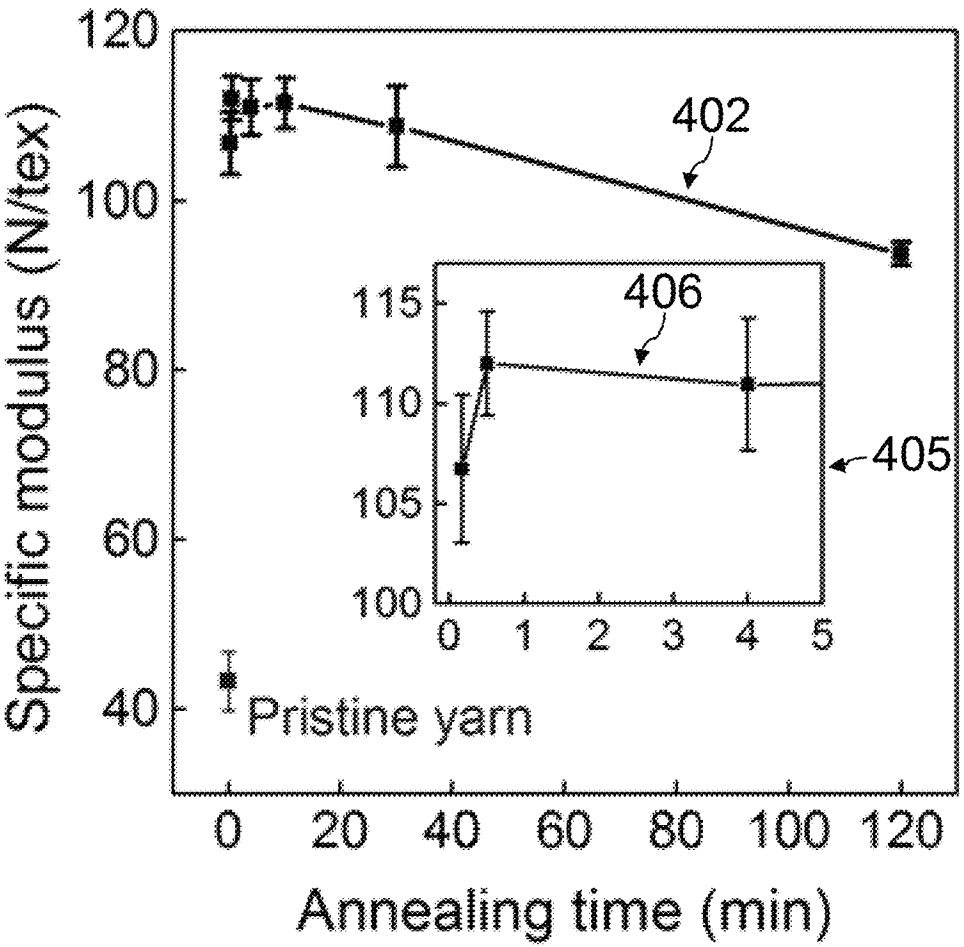
FIG. 4B is a graph showing specific modulus as a function of annealing time (at 2000° C. under 30% $\sigma_{max}$) during the ITAP.

Measurements of specific strength and specific modulus as a function of ITAP-30 at 2000° C. indicate that the benefit of this ITAP process on increasing these mechanical properties was achieved in less than 5 minutes and substantially most or all of this benefit can be realized for anneal times less than a minute. Excessive annealing times at this temperature during ITAP (above about 5 minutes) resulted in a decrease in specific strength and specific modulus. FIGS. 4A-4B are graphs showing, respectively, specific strength (plot 401) and specific modulus (plot 402) as a function of annealing time (at 2000° C. under 30% $\sigma_{max}$) during the ITAP. Insets 403 and 405 respectively show the strength (plot 404) and modulus (plot 406) in N/tex as function of time during the first five minutes of annealing. These results demonstrate that near maximum increases in strength and modulus were obtained by the ITAP within the first few seconds of annealing.

Independent of the density of the pristine twisted yarn, conducting ITAP-40 at 2000° C. for 2 minutes increased the specific modulus and specific strength, as well as the modulus and strength. Thermal annealing in a furnace provided essentially the same increase in these mechanical properties as did electrothermal heating by passing a current through the yarn.

Annealing a CNT yarn at higher temperature results in a shorter process time. When a twisted CNT yarn was treated by ITAP process at ~2600° C. with 40% of $\sigma_{max}$ applied stress, only 0.3 s is needed to achieve nearly identical mechanical strength and modulus as realized by conducting the ITAP process at 2000° C. for 2 minutes under the same applied stress.

Figure 5A:
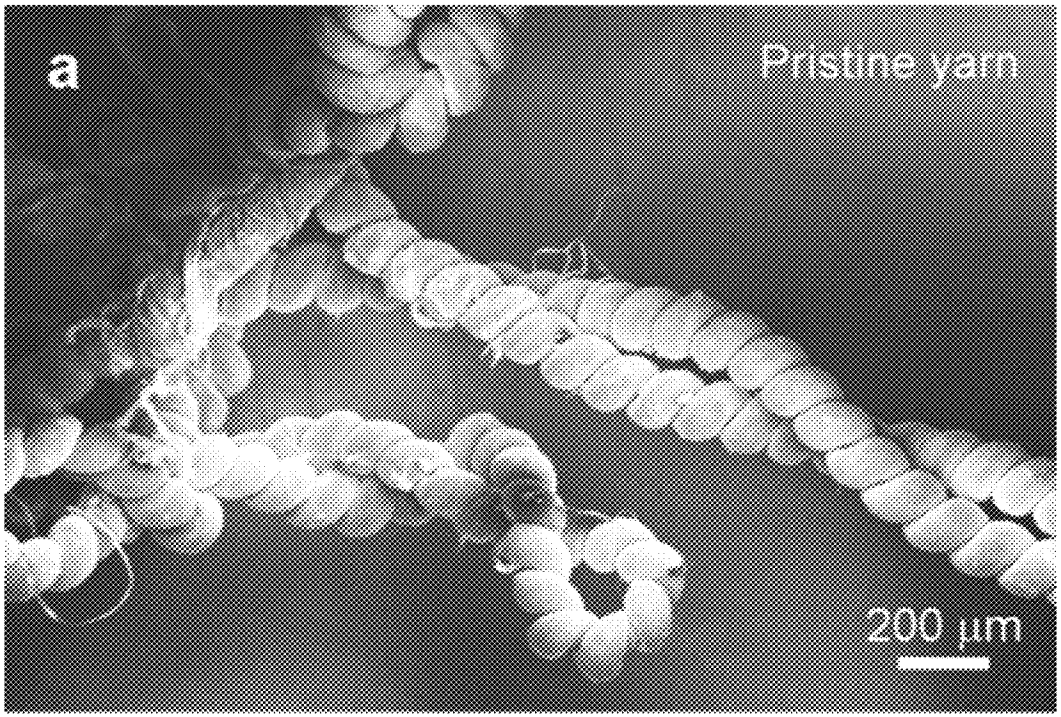
FIG. 5A is an SEM image of a pristine coiled multiwalled carbon nanotube (MWNT) yarn that has snarled during untethering.
Figure 5B:
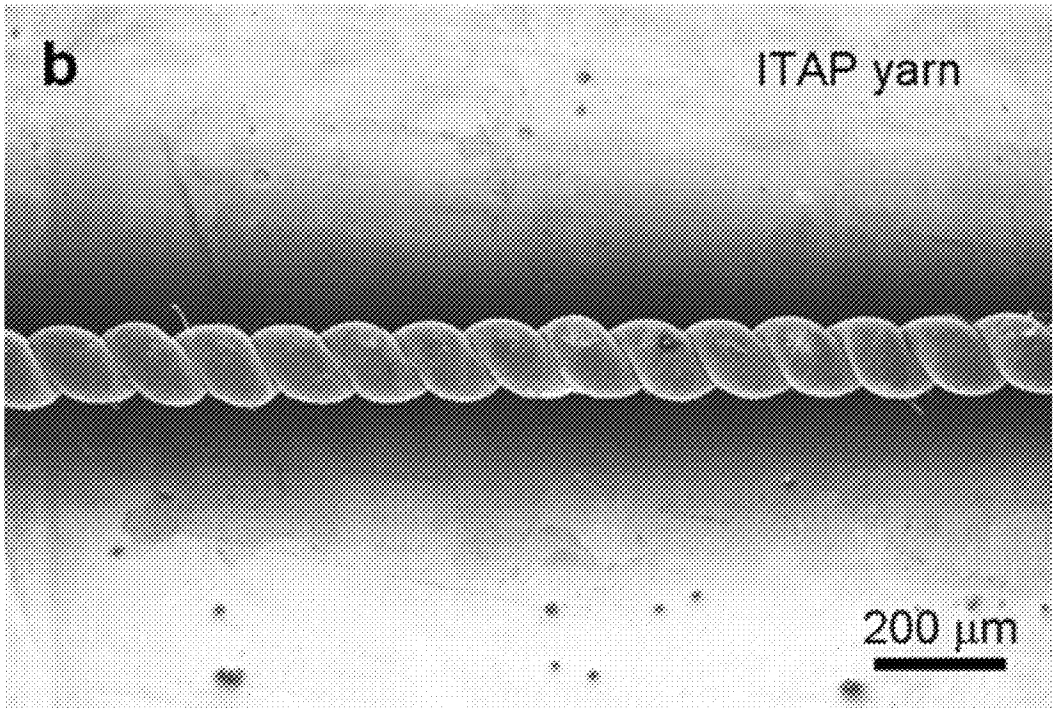
FIG. 5B is an SEM image of the same type of pristine coiled MWNT yarn of FIG. 5A that was untethered after ITAP-1.5.

FIGS. 5A-5B show that application of ITAP-1.5 to a coiled CNT yarn stabilizes a coiled CNT yarn with respect to both substantial yarn untwist and yarn snarling when tethering is released. FIGS. 5A-5B are, respectively, SEM images of (a) a pristine coiled MWNT yarn and (b) the same type of yarn after ITAP-1.5. When not tensionally constrained, the pristine yarn of FIG. 5A relaxed to snarl, whereas the annealed yarn of FIG. 5B remained straight, and did not undergo untwist. This indicated that the ITAP stabilized the twisted and the coiled structures of CNT yarns.

Example 2: ITAP CNT Composite Yarn

CNT/graphene oxide composite yarn was made by infiltrating an aqueous solution of dispersed graphene oxide particles into CNT sheets during twist-spinning. Annealing this CNT/graphene oxide composite yarn at 2000° C. with 30% of $\sigma_{max}$ applied stress for 2 minutes, results in a 1.7-fold increase in tensile strength and 4-fold increase of modulus.

Example 3: Torque Reduction by ITAP

The torque needed to prevent untwist is near zero for the ITAP-40 yarn, since the torque generated by yarn twist is balanced by forces due to ITAP-generated inter-nanotube connections. However, when tensile stress is applied to the ITAP yarns, this force balance is eliminated, so an external torque must be applied to prevent yarn untwist.

Figure 6:
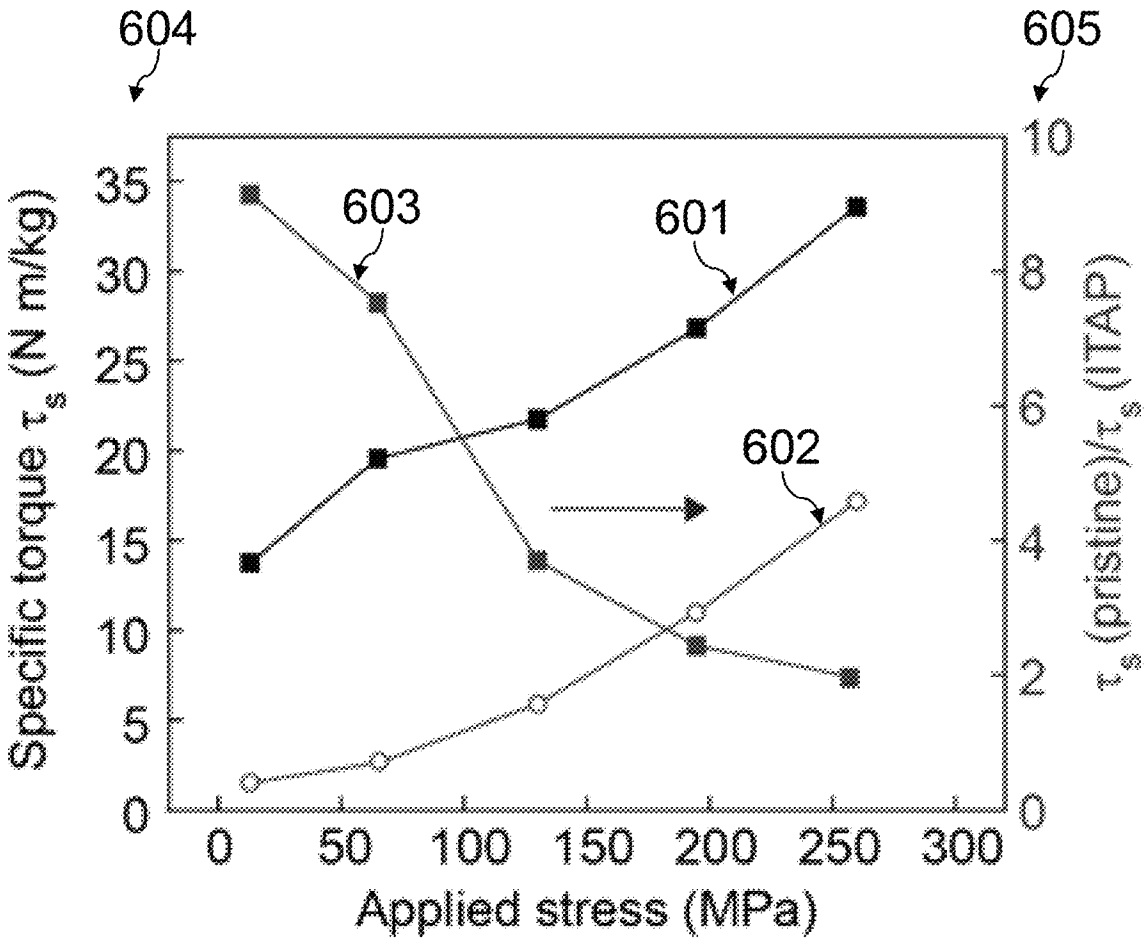
FIG. 6 is a graph showing comparisons of specific torque generated in a pristine yarn, t(pristine), and in an ITAP-40 yarn, t(ITAP), as a result of applying a tensile stress.

FIG. 6 shows the torque needed to counter yarn untwist as a function of applied tensile stress for both the pristine yarn and the corresponding ITAP-40 yarn, which had a diameter of 33 mm and a bias angle of 36. The specific torque ($t_s$) of the pristine yarn and the ITAP yarn are shown by lines 601 and 602, respectively. The ratio of the specific torque ($t_s$) of the pristine yarn to that of the ITAP yarn is shown by line 603. The specific torques are measured in N m $kg^{-1}$ as shown by the vertical axis 604. The ratio of the specific torques are unitless as shown by the vertical axis 605.

For the lowest applied tensile stress (13 MPa), the torque needed to prevent untwist was about 10 times lower for the ITAP yarn than for the pristine twisted yarn. Upon increasing tensile stress up to 260 MPa, this ratio of the torque for the ITAP yarn to that for the pristine yarn became about ½.

Example 4: Acid Corrosion Resistivity Enhancement by ITAP

The ITAP yarns have long-term structural and mechanical stability in chlorosulfonic acid, whose strong protonation ability ordinarily debundles carbon single wall nanotubes and MWNTs and causes CNT structures to swell and then disintegrate [Davis 2009; Parra-Vasquez 2010]. Upon immersion in chlorosulfonic acid for 4 minutes, the pristine twisted yarn swelled, untwisted, and became disordered, which led to a 10-fold decrease in yarn strength and a 5.8-fold decrease in modulus. In contrast, an ITAP-25 yarn remained aligned and densely packed, did not swell, and retained 82% of its modulus and 90% of its strength after immersion in chlorosulfonic acid for 5 minutes.

Figure 7A:
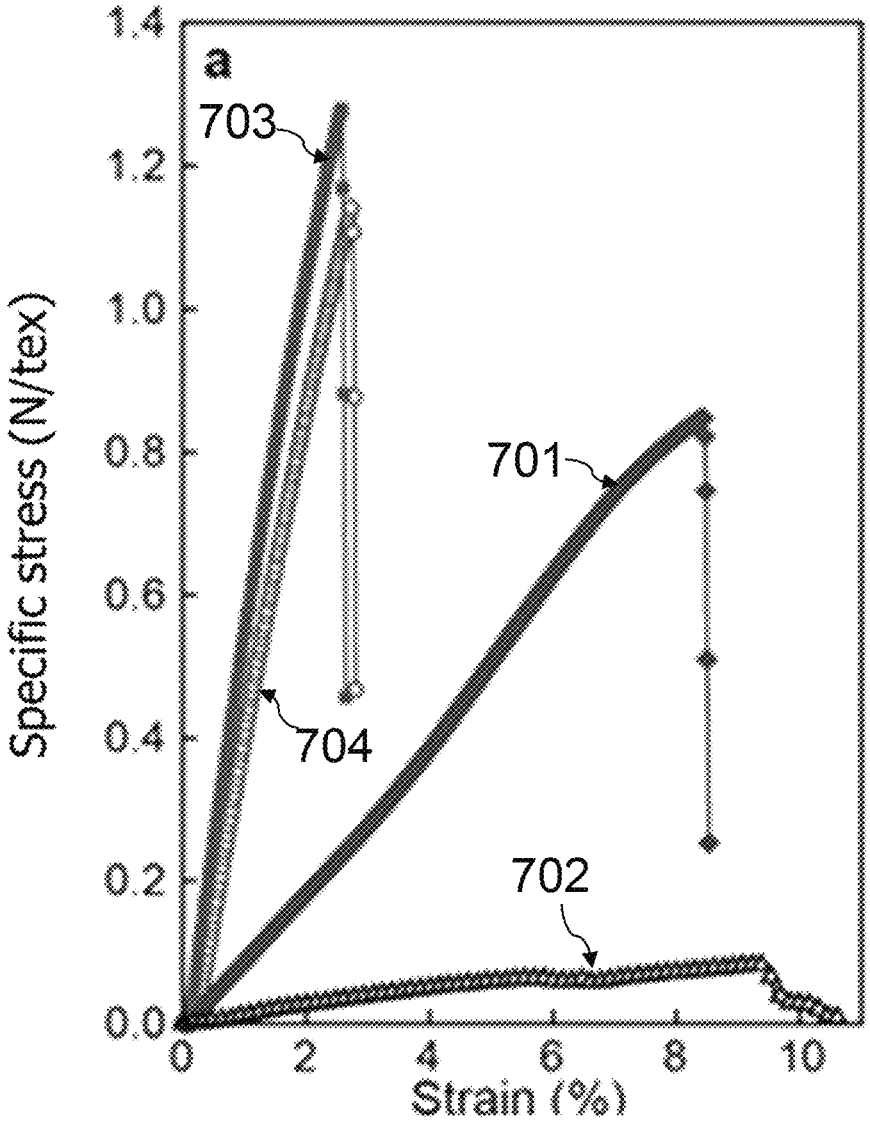
FIG. 7A is a graph showing comparisons of stress-strain curves for pristine yarns and ITAP-25 yarns before and after treatment in chlorosulfonic acid for 5 minutes and subsequent removal of this chlosulfonic acid from the yarn.
Figure 7B:
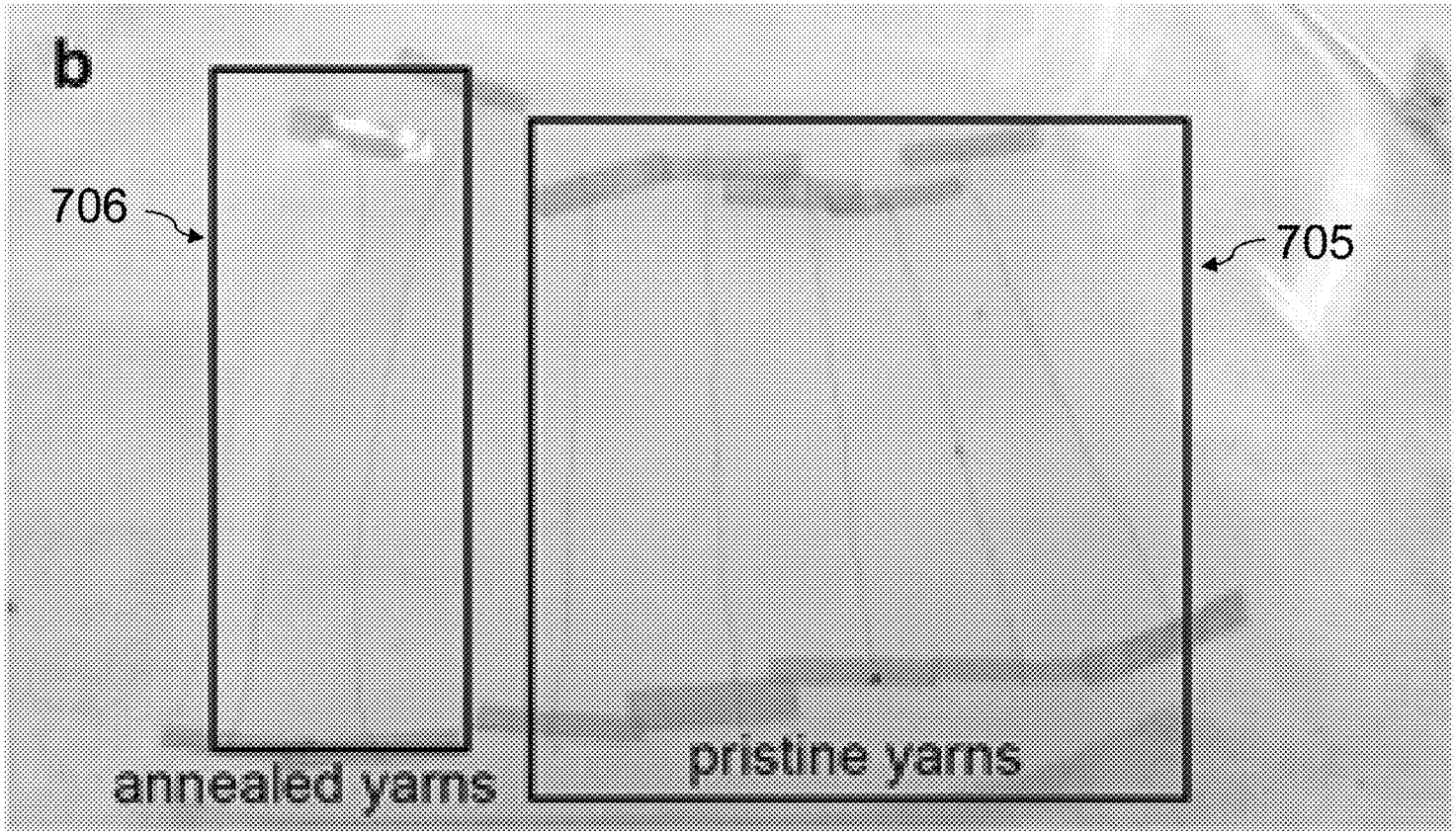
FIG. 7B is a photograph of the pristine yarns and ITAP-25 yarns before immersion in chlorosulfonic acid for 5 minutes.
Figure 7C:
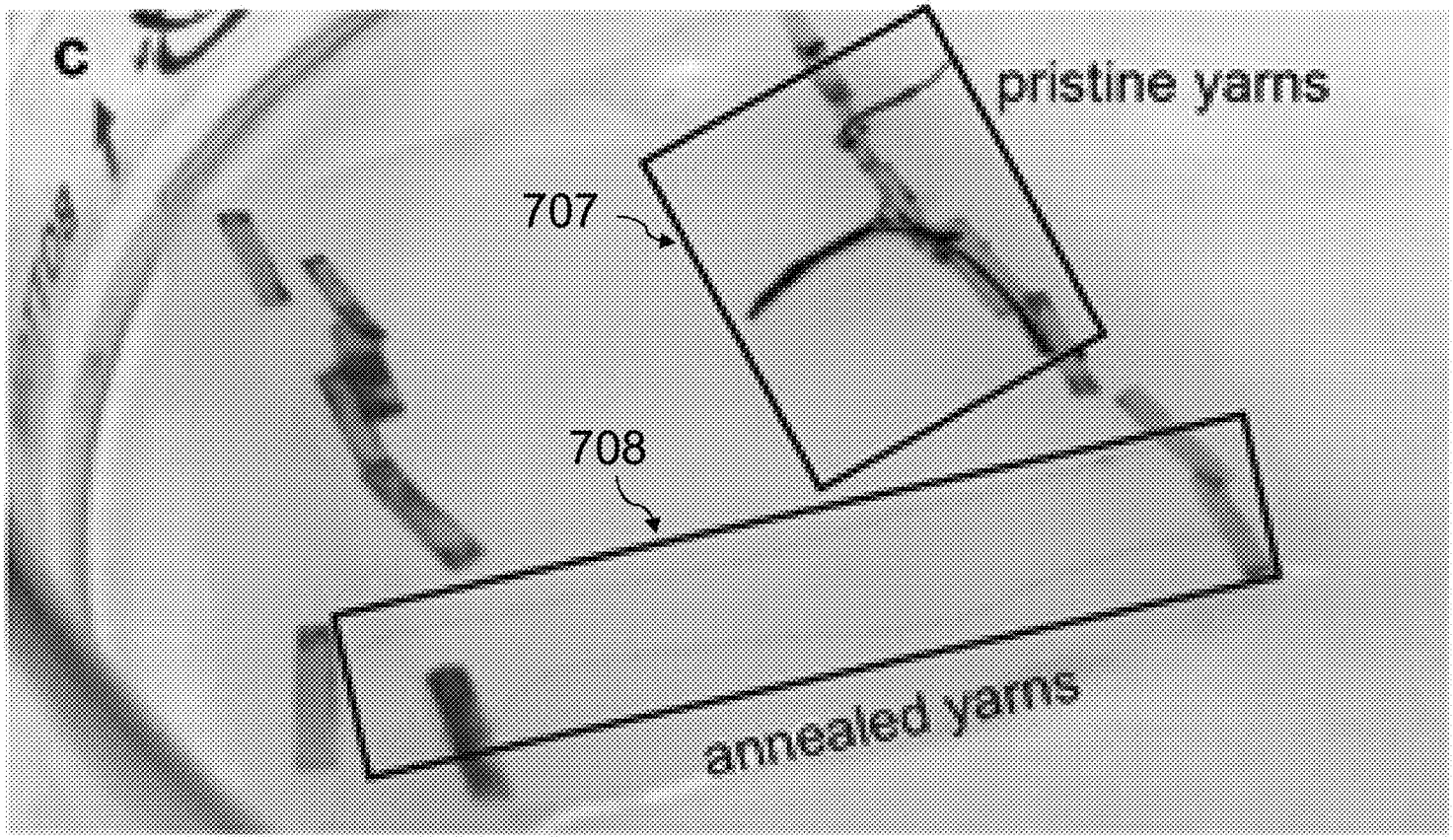
FIG. 7C is a photograph of the pristine yarns and ITAP-25 yarns after immersion in chlorosulfonic acid for 5 minutes.

FIG. 7A is a graph showing comparisons of stress-strain curves for pristine twisted yarns and ITAP-25 twisted yarns before and after treatment in chlorosulfonic acid for 5 minutes and subsequent removal of this chlosulfonic acid from the yarn. Lines 701-704 are the pristine twisted yarn (before treatment), acid treated twisted pristine yarn, ITAP-25 twisted yarn (before treatment), and acid treated ITAP-25 twisted yarn, respectively. FIG. 7B is a photograph of the pristine yarns 705 and ITAP-25 yarns 706 before immersion in chlorosulfonic acid for 5 minutes. FIG. 7C is a photograph of the pristine yarns 707 and ITAP-25 yarns 708 after immersion in chlorosulfonic acid for 5 minutes.

These results suggest that ITAP-induced crosslinking prohibited the chlorosulfonic acid from substantially penetrating and expanding the ITAP yarns.

Example 5: ITAP Yarn as a Torsional and Tensile Actuator

When exposed to acetone vapor, a 24-mm-long, 100-μm-thick coiled ITAP yarn reversibly rotated a 6100 times heavier rotor by 630 (corresponding to a rotation of 26 per millimeter of muscle length). The maximum rotational speed of the rotor was 44 rpm, and the muscle lifted a weight corresponding to a 2.9 MPa load by about 0.7% of the yarn length. Torsional angle oscillations were observed due to the cyclic inter-conversion of the kinetic energy of the rotating rotor to the strain energy of rotor rotation as the rotors kinetic energy was progressively damped. These oscillations in torsional actuation were eliminated by operating the muscle at near torsional resonance by using a vapor on/off cycle frequency of 0.18 Hz. Such resonant operation increased torsional actuator stroke and maximum rotor speed by factors of 2.6 and 3.5, respectively (to 52 $mm^{-1}$ and 160 rpm, respectively). It also caused a phase shift of about ¼ period between the curves for the time dependence of torsional and tensile strokes, which provided near coincidence of the peaks in rotor speed and tensile stroke.

Reflecting the mechanical robustness of the coiled ITAP yarn to irreversible yarn untwist, reversible torsional and tensile actuation was obtained even when high weight torsional rotors were deployed. While increasing yarn stress from 2.9 to 13.5 MPa (corresponding to 28,400 times the muscle weight) by increasing rotor weight did not dramatically change torsional actuation stroke, the corresponding increase of moment of inertia for the rotor (from $8.0\times10^{-9}$ to $4.8\times10^{-7}$ kg $m^2$) decreased maximum rotation speed from 155 to 51 rpm. The obtained maximum torque was 4.12 N-m per kilogram of the yarn mass, which was several times the torque of electrochemically and absorption driven CNT muscles [Foroughi 2011; P. Chen 2015; He 2015], 50 times the torque generated by the moisture-driven graphene-yarn torsional actuator [Cheng 2014], and comparable to the static torque of the electrothermally driven wax-filled CNT muscles [Lima 2012]. Moreover, such ITAP yarns showed highly reversible torsional actuation.

Additional information of the present invention is included in J. Di et al., "Strong, Twist-Stable Carbon Nanotube Yarns and Muscles by Tension Annealing at Extreme Temperatures," *Adv Mater* 28, 6598-6605 (2016) and the accompanying J. Di, et al., "Supporting Information for Strong, Twist-Stable Carbon Nanotube Yarns and Muscles by Tension Annealing at Extreme Temperatures," which both are hereby incorporated herein by reference.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above.

The disclosures of all patents, patent applications, and publications cited herein are hereby incorporated herein by reference in their entirety, to the extent that they provide exemplary, procedural, or other details supplementary to those set forth herein.

REFERENCES

K. Asaka, M. Karita, Y. Saito, Graphitization of amorphous carbon on a multiwall carbon nanotube surface by catalyst-free heating. *Appl Phys Lett* 99, 091907 (2011) ("Asaka 2011").

N. Behabtu et al., Strong, light, multifunctional fibers of carbon nanotubes with ultrahigh conductivity. *Science* 339, 182-186 (2013) ("Behabtu 2013").

K. Behler, S. Osswald, H. Ye, S. Dimovski, Y. Gogotsi, Effect of thermal treatment on the structure of multi-walled carbon nanotubes. *J Nanopart Res* 8, 615-625 (2006) ("Behler 2006").

P. Chen et al., Hierarchically arranged helical fibre actuators driven by solvents and vapours. *Nat Nanotechnol* 10, 1077-1083 (2015) ("P. Chen 2015").

X. Chen et al., Novel electric double-layer capacitor with a coaxial fiber structure. *Adv Mater* 25, 6436-6441 (2013) ("X. Chen 2013").

H. H. Cheng et al., Moisture-activated torsional graphene-fiber motor. *Adv Mater* 26, 2909-2913 (2014) ("Cheng 2014").

F. Colonna, A. Fasolino, E. J. Meijer, Graphitization of single-wall nanotube bundles at extreme conditions: Collapse or coalescence route. *Phys Rev B* 88, 165416 (2013) ("Colonna 2013").

V. A. Davis et al., True solutions of single-walled carbon nanotubes for assembly into macroscopic materials. *Nat Nanotechnol* 4, 830-834 (2009) ("Davis 2009").

L. M. Ericson et al., Macroscopic, neat, single-walled carbon nanotube fibers. *Science* 305, 1447-1450 (2004) ("Ericson 2004").

C. Fang et al., Enhanced carbon nanotube fibers by polyimide. *Appl Phys Lett* 97, 181906 (2010) ("Fang 2010").

T. Filleter, R. Bernal, S. Li, H. D. Espinosa, Ultrahigh strength and stiffness in cross-linked hierarchical carbon nanotube bundles. *Adv Mater* 23, 2855-2860 (2011) ("Filleter 2011").

T. Filleter, H. D. Espinosa, Multi-scale mechanical improvement produced in carbon nanotube fibers by irradiation cross-linking. *Carbon* 56, 1-11 (2013) ("Filleter 2003").

J. Foroughi et al., Torsional carbon nanotube artificial muscles. *Science* 334, 494-497 (2011) ("Foroughi 2011").

H. R. Gutierrez, U. J. Kim, J. P. Kim, P. C. Eklund, Thermal conversion of bundled carbon nanotubes into graphitic ribbons. *Nano Lett* 5, 2195-2201 (2005) ("Gutierrez 2005").

S. He et al., A Mechanically Actuating carbon-nanotube fiber in response to water and moisture. *Angew Chem Int Ed* 127, 15093-15097 (2015) ("He 2015").

J. Y. Huang, S. Chen, Z. F. Ren, G. Chen, M. S. Dresselhaus, Real-time observation of tubule formation from amorphous carbon nanowires under high-bias Joule heating. *Nano Lett* 6, 1699-1705 (2006) ("J. Huang 2006").

W. Huang, Y. Wang, G. Luo, F. Wei, 99.9% purity multi-walled carbon nanotubes by vacuum high-temperature annealing. *Carbon* 41, 2585-2590 (2003) ("W. Huang 2003").

C. Jayasinghe, S. Chakrabarti, M. J. Schulz, V. Shanov, Spinning yarn from long carbon nanotube arrays. *J Mater Res* 26, 645-651 (2011) ("Jayasinghe 2011").

K. L. Jiang, Q. Q. Li, S. S. Fan, Nanotechnology: Spinning continuous carbon nanotube yarns—Carbon nanotubes weave their way into a range of imaginative macroscopic applications. *Nature* 419, 801 (2002) ("Jiang 2002").

R. K. Josephson, Contraction dynamics and power output of skeletal muscle. *Annu Rev Physiol* 55, 527-546 (1993) ("Josephson 1993").

A. Kis et al., Reinforcement of single-walled carbon nanotube bundles by intertube bridging. *Nat Mater* 3, 153-157 (2004) ("Kris 2004").

A. V. Krasheninnikov, F. Banhart, Engineering of nanostructured carbon materials with electron or ion beams. *Nat Mater* 6, 723-733 (2007) ("Krasheninnikov 2007").

Y. Li et al., Overtwisted, resolvable carbon nanotube yarn entanglement as strain sensors and rotational actuators. *ACS Nano* 7, 8128-8135 (2013) ("Li 2013").

Y. L. Li, I. A. Kinloch, A. H. Windle, Direct spinning of carbon nanotube fibers from chemical vapor deposition synthesis. *Science* 304, 276-278 (2004) ("Li 2004").

M. D. Lima et al., Efficient, Absorption-powered artificial muscles based on carbon nanotube hybrid yarns. *Small* 11, 3113-3118 (2015) ("Lima 2015").

M. D. Lima et al., Electrically, chemically, and photonically powered torsional and tensile actuation of hybrid carbon nanotube yarn muscles. *Science* 338, 928-932 (2012) ("Lima 2012").

K. Liu et al., Scratch-resistant, highly conductive, and high-strength carbon nanotube-based composite yarns. *ACS Nano* 4, 5827-5834 (2010) ("Liu 2010").

W. Lu, M. Zu, J. H. Byun, B. S. Kim, T. W. Chou, State of the art of carbon nanotube fibers: opportunities and challenges. *Adv Mater* 24, 1805-1833 (2012) ("Lu 2012").

M. Miao et al., Effect of gamma-irradiation on the mechanical properties of carbon nanotube yarns. *Carbon* 49, 4940-4947 (2011) ("Miao 2011").

A. N. Parra-Vasquez et al., Spontaneous dissolution of ultralong single- and multiwalled carbon nanotubes. *ACS Nano* 4, 3969-3978 (2010) ("Parra-Vasquez 2010").

S. Ryu et al., High-strength carbon nanotube fibers fabricated by infiltration and curing of mussel-inspired catecholamine polymer. *Adv Mater* 23, 1971-1975 (2011) ("Ryu 2011").

E. Salonen, A. Krasheninnikov, K. Nordlund, Ion-irradiation-induced defects in bundles of carbon nanotubes. *Nucl. Instrum. Methods Phys. Res., Sect. B* 193, 603-608 (2002) ("Salonen 2002").

M. Terrones, H. Terrones, F. Banhart, J. Charlier, P. M. Ajayan, Coalescence of single-walled carbon nanotubes. *Science* 288, 1226-1229 (2000) ("Terrones 2000").

B. Vigolo et al., Macroscopic fibers and ribbons of oriented carbon nanotubes. *Science* 290, 1331-1334 (2000) ("Vigolo 2000").

G. Yamamoto et al., Structure-property relationships in thermally-annealed multi-walled carbon nanotubes. *Carbon* 66, 219-226 (2014) ("Yamamoto 2014").

W. Weng et al., Winding aligned carbon nanotube composite yarns into coaxial fiber full batteries with high performances. *Nano Lett* 14, 3432-3438 (2014) ("Weng 2014").

M. Zhang, K. R. Atkinson, R. H. Baughman, Multifunctional carbon nanotube yarns by downsizing an ancient technology. *Science* 306, 1358-1361 (2004) ("M. Zhang 2004").

X. B. Zhang et al., Spinning and processing continuous yarns from 4-inch wafer scale super-aligned carbon nanotube arrays. *Adv Mater* 18, 1505-1510 (2006) ("X. B. Zhang 2006").

PCT Patent WO2011005375, Fabrication of biscrolled fiber using carbon nanotube sheet. to S. Fang, filed May 27, 2010 ("S. Fang '375 PCT Application")

X. F. Zhang et al., Ultrastrong, stiff, and lightweight carbon-nanotube fibers. *Adv Mater* 19, 4198-4201 (2007) ("X. F. Zhang 2007").

PCT Patent Appl. Publ. No. WO2014/0022667, "Coiled and non-coiled twisted nanofiber yarn and polymer fiber torsional and tensile actuators," to N. Li, filed Aug. 1, 2013 ("Li '667 PCT Application").

What is claimed is:

1. A process comprising:

(a) applying a tensile stress to a twisted, torsionally-tethered CNT yarn, wherein the twisted, torsionally-tethered CNT yarn is coiled or not coiled; and (b) high-temperature annealing the twisted, torsionally-tethered CNT yarn while the tensile stress and torsional tethering is applied to the twisted, torsionally-tethered CNT yarn to form a twisted ITAP yarn that is coiled or not coiled, wherein (i) the high-temperature annealing is performed in the range between 1000° C. and 3000° C. and (ii) the twisted ITAP yarn has a characteristic selected from the group consisting of (A) the tensile strength of the twisted ITAP yarn is greater than for the twisted, torsionally-tethered CNT yarn, (B) the tensile modulus of the twisted ITAP yarn is greater than for the twisted, torsionally-tethered CNT yarn, (C) the twisted ITAP yarn is stabilized with respect to irreversible untwist when the torsional tethering is removed, (D) the twisted ITAP yarn is stabilized with respect to snarling when the tensile stress is decreased, (E) the twisted ITAP yarn is stabilized with respect to chemically-induced yarn degradation, and (F) combinations thereof.

2. The process of claim 1, wherein the step of high-temperature annealing comprises heating the twisted, torsionally-tethered CNT yarn by a method selected from the group consisting of:

(a) applying an electrical current through the twisted, torsionally-tethered CNT yarn, (b) placing the twisted, torsionally-tethered CNT yarn in a high-temperature environment, (c) absorption of electromagnetic radiation, (d) inductive heating, and (e) combinations thereof.

3. The process of claim 1, wherein the twisted, torsionally-tethered CNT yarn is a twisted, torsionally-tethered CNT yarn that is not coiled.

4. The process of claim 1, wherein the tensile stress applied to the twisted, torsionally-tethered CNT yarn during the step of high-temperature annealing is at least 5% of fracture strength of the twisted, torsionally-tethered CNT yarn at room temperature before the step of high-temperature annealing.

5. The process of claim 4, wherein the tensile stress applied to the twisted, torsionally-tethered CNT yarn during the step of high-temperature annealing is at least 20% of the fracture strength of the twisted, torsionally-tethered CNT yarn at room temperature before the step of high-temperature annealing.

6. The process of claim 5, wherein the tensile stress applied to the twisted, torsionally-tethered CNT yarn during step of high-temperature annealing increases with increasing time over a first time period occurring during the step of high-temperature annealing, while maintaining the tensile stress at below an applied stress level that would cause damage to the twisted, torsionally-tethered CNT yarn at the high-temperature annealing temperature.

7. The process of claim 1, wherein (a) the twisted, torsionally-tethered CNT yarn is a twisted and coiled, torsionally-tethered CNT yarn that is mandrel-free, and (b) the tensile stress applied to the twisted and coiled, torsionally-tethered CNT yarn is in an amount that avoids yarn snarling of the twisted and coiled, torsionally-tethered CNT yarn.

8. The process of claim 7, wherein the tensile stress applied to the twisted and coiled, torsionally-tethered CNT yarn is at least 1% of fracture strength of the twisted and coiled, torsionally-tethered CNT yarn at room temperature before the step of high-temperature annealing.

9. The process of claim 1, wherein an inert environment is employed during the step of high-temperature annealing.

10. The process of claim 1 further comprising removing oxygen adsorbed from the twisted, torsionally-tethered CNT yarn before the twisted, torsionally-tethered CNT yarn reaches incandescent temperatures during annealing.

11. The process of claim 10, wherein the step of removing oxygen comprises a method selected from the group consisting of:

(a) applying an electrical current through the twisted, torsionally-tethered CNT yarn, (b) placing the yarn in a high-temperature environment, (c) absorption of electromagnetic radiation, (d) inductive heating, and (e) combinations thereof.

12. The process of claim 1, wherein time of the step of the high-temperature annealing ranges from 0.1 milliseconds to 2 hours.

13. The process of claim 1 further comprising the method of forming the twisted, torsionally-tethered CNT yarn, wherein the step of forming the CNT yarn is selected from the group consisting of spinning from CNT forests, CNT solutions, and CNT aerogel sheets grown by floating catalytic chemical vapor deposition.

14. The process of claim 1, wherein the process is a continuous process or a batch by batch process.

15. The process of claim 1, wherein the twisted, torsionally-tethered CNT yarn is part of an assembly comprising a plurality of additional twisted, torsionally-tethered CNT yarns.

16. The process of claim 15, wherein the additional twisted, torsionally-tethered CNT yarns in the assembly are formed into additional twisted ITAP yarns while held under different levels of tensile stresses and temperatures than the tensile stress and temperature used to form the twisted ITAP yarn.

17. The process of claim 15, wherein at least some of the additional twisted, torsionally-tethered CNT yarns in the assembly are not formed into additional twisted ITAP yarns.

18. The process of claim 15, wherein all of the additional twisted, torsionally-tethered CNT yarns in the assembly are formed into additional twisted ITAP yarns while being subjected to a tensile stress and temperature that is substantially the same tensile stress and temperature used to form the twisted ITAP yarn.

19. The process of claim 15, wherein the twisted, torsionally-tethered CNT yarn and the additional twisted, torsionally-tethered CNT yarns in the assembly are woven into a textile.

20. The process of claim 15, wherein at least some portion of the twisted, torsionally-tethered CNT yarn and the additional twisted, torsionally-tethered CNT yarns in the assembly are plied.

21. The process of claim 1, wherein the twisted, torsionally-tethered CNT yarn further comprises at least one additional material other than CNTs.

22. The process of claim 21, wherein the twisted, torsionally tethered CNT yarn comprises a ceramic material.

23. The process of claim 1, wherein the twisted, torsionally-tethered CNT yarn comprises a second carbon material, wherein the second carbon material is not CNTs.

24. The process of claim 23, wherein the second carbon material comprises graphene or a graphene derivative.

25. The process of claim 1, wherein the twisted, torsionally-tethered CNT yarn comprises substantially only CNTs.

26. The process of claim 1 further comprising:

(a) applying a first tensile stress to a torsionally-tethered CNT yarn; and (b) twisting the torsionally-tethered CNT yarn while the first tensile stress is applied to form the twisted, torsionally-tethered CNT yarn.

27. The process of claim 26, wherein the first tensile stress applied to the torsionally-tethered CNT yarn is different than the tensile stress applied during the step of high-temperature annealing of the twisted, torsionally tethered CNT yarn.

28. A process comprising:

(a) applying a tensile stress to a twisted CNT yarn, wherein the twisted CNT yarn is coiled or not coiled; and (b) high-temperature annealing the twisted CNT yarn while the tensile stress is applied to the twisted CNT yarn to form a twisted ITAP yarn that is coiled or not coiled, wherein (i) the high-temperature annealing is performed in the range between 1000° C. and 3000° C., (ii) the tensile stress applied to the twisted CNT yarn during the step of high-temperature annealing is at least 20% of fracture strength of the twisted CNT yarn at room temperature before the step of high-temperature annealing, and (iii) the tensile stress applied to the twisted CNT yarn during the step of high-temperature annealing increases with increasing time over a first time period occurring during the step of high-temperature annealing, while maintaining the tensile stress at below an applied stress level that would cause damage to the twisted CNT yarn at the high-temperature annealing temperature, and (iv) the twisted ITAP yarn has a characteristic selected from the group consisting of (A) the tensile strength of the twisted ITAP yarn is greater than the twisted CNT yarn, (B) the tensile modulus of the twisted ITAP yarn is greater than the twisted CNT yarn, (C) the twisted ITAP yarn is stabilized with respect to irreversible untwist or snarling, thereby avoiding the need to tether the twisted ITAP yarn, (D) the twisted ITAP yarn is stabilized with respect to chemically-induced yarn degradation, and (E) combinations thereof.

* * * * *